US010413088B2

(12) United States Patent
Curtis

(10) Patent No.: US 10,413,088 B2
(45) Date of Patent: Sep. 17, 2019

(54) BEDSIDE COT

(71) Applicant: BABYHUB LTD, St. Clements, Jersey Channel Islands (GB)

(72) Inventor: Catherine Dolores Curtis, Channel Islands (GB)

(73) Assignee: BABYHUB LTD. (GB)

( * ) Notice: Subject to any disclaimer, the term of this patent is extended or adjusted under 35 U.S.C. 154(b) by 316 days.

(21) Appl. No.: 15/039,332

(22) PCT Filed: Nov. 25, 2014

(86) PCT No.: PCT/GB2014/053492
§ 371 (c)(1),
(2) Date: May 25, 2016

(87) PCT Pub. No.: WO2015/075484
PCT Pub. Date: May 28, 2015

(65) Prior Publication Data

US 2017/0156511 A1 Jun. 8, 2017

(30) Foreign Application Priority Data

Nov. 25, 2013 (GB) ..... 1320748.5

(51) Int. Cl.
*A47D 7/02* (2006.01)
*A47C 31/10* (2006.01)
(Continued)

(52) U.S. Cl.
CPC ..... *A47D 7/02* (2013.01); *A47C 31/105* (2013.01); *A47D 7/04* (2013.01); *A47D 15/001* (2013.01)

(58) Field of Classification Search
CPC .... A47C 31/105; A47D 15/00; A47D 15/001; A47D 15/003; A47D 15/005;
(Continued)

(56) References Cited

U.S. PATENT DOCUMENTS 328,157 A * 10/1885 Tyler ..... A47D 7/04 5/95
472,647 A * 4/1892 Walker ..... A47D 7/04 5/95
(Continued)

FOREIGN PATENT DOCUMENTS

DE 2212332 A1 9/1973
DE 3245089 A1 6/1984
(Continued)

OTHER PUBLICATIONS

International Search Report dated May 20, 2014 for International Application No. GB 1320748.5 (2 pages).
(Continued)

*Primary Examiner* — Eric J Kurilla
(74) *Attorney, Agent, or Firm* — Tarolli, Sundheim, Covell & Tummino LLP; Samantha R. Smart, Esq.

(57) ABSTRACT

The invention relates to a wall (4) of a bedside cot or the like, capable of pivoting from a first upright position to a second, horizontal position; the wall (4) is tapering from its base (5) to its distal edge (9). It is also disclosed a mattress cover (3) and a fitted sheet comprising a cuboid space and a wedge-shaped space connected together along one edge of the cuboid and one edge of the base base of the wedge shaped space.

19 Claims, 6 Drawing Sheets

(51) Int. Cl.
*A47D 7/04* (2006.01)
*A47D 15/00* (2006.01)

(58) Field of Classification Search
CPC ..... A47D 15/008; A47D 7/002; A47D 7/02; A47D 7/04; A47D 9/00; A47D 9/005
See application file for complete search history.

(56) References Cited

U.S. PATENT DOCUMENTS 533,462 A * 2/1895 Hoagland ..... A47D 7/04 5/95
548,005 A * 10/1895 Miller, Jr. ..... A47D 7/04 5/95
608,523 A * 8/1898 Lucas ..... A47D 7/04 5/95
793,168 A * 6/1905 Abrams ..... A47D 7/04 5/411
949,389 A * 2/1910 Almgren ..... A47D 7/02 5/100
1,563,428 A * 12/1925 Melton ..... A47D 7/04 5/308
2,622,250 A 12/1952 Coles
3,427,666 A * 2/1969 Saxe ..... A47D 5/00 312/314
4,802,249 A 2/1989 Bills
4,905,330 A 3/1990 Jacobs
4,987,625 A * 1/1991 Edelson ..... A47C 20/026 5/420
5,172,435 A * 12/1992 Griffin ..... A47D 7/04 5/312
5,293,655 A * 3/1994 VanWinkle ..... A47D 7/04 5/185
6,148,456 A * 11/2000 Tharalson ..... A47C 29/003 5/11
6,202,228 B1 * 3/2001 Cox ..... A47D 7/04 5/940
6,457,196 B1 * 10/2002 Dykes ..... A61G 11/00 5/603
6,862,757 B2 * 3/2005 Andriunas ..... A47D 7/04 5/93.2
8,429,771 B2 * 4/2013 Long ..... A47D 7/04 5/100
8,745,780 B2 * 6/2014 Su ..... A47D 7/04 312/301
2002/0083524 A1 * 7/2002 Tharalson ..... A47D 7/04 5/95
2002/0152550 A1 * 10/2002 Tharalson ..... A47D 5/00 5/95
2003/0037372 A1 * 2/2003 Andriunas ..... A01K 1/0353 5/95
2003/0126681 A1 * 7/2003 Tharalson ..... A47D 5/00 5/93.2
2007/0277321 A1 * 12/2007 Leach ..... A47D 5/006 5/655
2008/0052821 A1 * 3/2008 Morton ..... A47D 7/04 5/93.1
2009/0205140 A1 * 8/2009 Reese ..... A47D 13/063 5/714
2010/0088819 A1 * 4/2010 Carter ..... A47C 27/008 5/484
2011/0119832 A1 * 5/2011 Hung ..... A47D 9/005 5/655
2011/0308011 A1 * 12/2011 Cheng ..... A47D 7/04 5/93.1
2014/0096320 A1 * 4/2014 Wilson ..... A47D 15/008 5/424

FOREIGN PATENT DOCUMENTS

| | | | |
|---|---|---|---|
| DE | 8407950 | | 6/1984 |
| DE | 202005013729 | U1 | 12/2005 |
| GB | 2297915 | A | 8/1996 |
| GB | 2453322 | A | 8/2009 |
| GB | 2478980 | A | 9/2011 |
| GB | 2501526 | A | 10/2013 |
| WO | WO 00/23026 | | 4/2000 |
| WO | WO 2015/075484 | A1 | 5/2015 |

OTHER PUBLICATIONS

International Search Report dated Feb. 5, 2016 for International Application No. GB 1320748.5 (2 pages).
International Search Report dated Feb. 11, 2015 for International Application No. PCT/GB2014/053492 (2 pages).

* cited by examiner

BEDSIDE COT

CROSS REFERENCES TO RELATED APPLICATION

The present application is a 35 U.S.C. § 371 National Stage Patent Application claiming priority to International PCT Application Serial No. PCT/GB2014/053492 having an International filing date of Nov. 25, 2014 and that was published on May 28, 2015 under international publication number WO 2015/075484, which claims priority to Great Britain Patent Application Serial No. 1320748.5 that was filed on Nov. 25, 2013. This Application claims priority to and incorporates by reference the above-identified applications in their entireties for all purposes.

This invention relates to cots and the like and in particular to a wall for a cot, which may form part of a cot, or be part of a mattress, or even part of a cover for a mattress.

Cots, and the like, such as cribs, bassinets, Moses-baskets, cradles and co-sleepers come in various forms, but the present invention relates in particular to those which are adapted to be placed adjacent the side of a parent bed, of which U.S. Pat. No. 5,172,435 is one example. Even more particularly the invention relates to such cots and the like in which a wall of the cot adjacent the parent bed can be lowered onto the mattress of the parent bed to allow, for example, a mother lying on the parent bed access to the cot, and hence to a baby within the cot.

Particular examples of such cots may be found in U.S. Pat. No. 793,168 and EP2317983.

Both of these examples have a sidewall pivotally mounted, at its base, on a bar, about which it can rotate onto the mattress of the parent bed and bridge the gap between the parent mattress and the cot mattress, in the fashion of a drawbridge.

In U.S. Pat. No. 793,168 the sidewall is constructed as a frame with additional bars between the sides of the frame, two of which serve as tracks along which a trolley carrying a mattress (and baby) can slide out.

In EP2317983 again the sidewall is constructed as a frame, but no bars are provided, instead, the frame is enveloped by a fabric covering which includes a transparent section, formed for example by mesh to allow the inside of the cot to be viewed from the parent bed, even when the wall is raised.

An object of the invention is to provide an improved wall for a bedside cot, or the like.

Accordingly, in a first aspect of the invention, there is provided a wall of a bedside cot or the like, capable of pivoting from a first, upright, position, to a second, horizontal position; the wall tapering from its base to its distal edge.

In a second aspect of the invention, there is provided a wall of a bedside cot or the like, capable of pivoting from a first upright position to a second horizontal position; the wall being formed of resilient material.

Both of these aspects of the invention provide improvement in terms of comfort when the wall is in the horizontal position, overlying the mattress of the parent bed. In the prior art described above in relation to U.S. Pat. No. 793,168, the baby had to be wheeled out of the cot on a trolley, with the height of the trolley disturbing interaction between a parent on the parent bed and the baby on the trolley. In EP2317983 on the other hand, the baby could be rolled out onto the sidewall, or the parent could lie partially on the sidewall, and interact with the baby in the cot, but the frame structure, with its hoop shaped rods of metal (or very tough plastics) could prove uncomfortable to both baby and parent.

Alternative constructions for opening the sidewall are known, such as drop-sides, which are lowered vertically whilst remaining upright, but these do not have the drawbridge effect and leave a gap between the parent bed and the bedside cot, which can be dangerous, with the baby potentially falling through the gap. Even if the space between the parent bed and the bedside cot is not big enough for a baby to fall through, any gap has the potential to trap a baby's limb or digit.

Preferably the wall is both tapered from its base to its distal edge and formed of resilient material.

Preferably the wall is formed from upholstery foam, such as polyester foam. Alternatively it may be formed of coir or wool. Preferably the resilient part, e.g. upholstery foam, coir, or wool is attached to a backing board, such that in the horizontal position a resilient portion overlies the backing board.

Preferably the wall includes a cover covering the outer surface. Preferably the cover is waterproof. Preferably the waterproof cover is formed of PVC.

Preferably the wall comprises fasteners (e.g. snap fasteners) for fastening the wall to a cot or the like, in the upright position.

One embodiment provides a mattress cover comprising a wall as described above. Preferably the mattress cover comprises a flexible sheet having an opening to envelope a mattress and is arranged such that in use one end the mattress is situated adjacent the base of the wall, the cover connecting the mattress and the wall, such that the wall can pivot between a first upright position perpendicular to the mattress to a second horizontal position alongside the mattress.

In another embodiment a mattress for a bedside cot or the like is provided which comprises a wall as defined above Provision of a mattress cover comprising such a wall, or a mattress comprising such a wall, has the result that in the horizontal position, a continuous surface can be provided from the mattress of the baby's cot to the mattress of the bed, with the wall providing a bridge with no gap at all between it and the mattress of the cot.

Preferably the body of the mattress is connected to the wall (optionally by the cover) such that in the upright position, the base of the sidewall has a first, inward, edge and a second, outward, edge, with the first edge of the base of the wall adjacent the top edge of the outward end of the mattress and in the horizontal position, the first edge remains adjacent the top edge of the outward end of the mattress and the second edge is lower than the first edge.

Such a construction allows the outward end of the mattress to be held inside a bedside cot by an upstanding retaining lip. In the horizontal position, depending on the relative depths of the sidewall and the body of the mattress, and the height of the lip, the lip can be sandwiched between the base of the side-wall and the body of the mattress.

In another preferred embodiment a bedside cot or the like comprises a wall as defined above. While such a construction would still have the potential to leave a small gap between the mattress of the cot and the upper surface of the sidewall in the horizontal position, the advantages in terms of comfort would still be achieved.

In a further aspect of the invention a bedside cot is provided which comprises a mattress as defined above.

Yet another aspect of the invention provides a mattress cover comprising a cuboid space and a wedge-shaped space connected together along one edge of the cuboid space and one edge of the base of the wedge shaped space.

And in another associated aspect the invention provides a fitted sheet comprising a cuboid space and a wedge-shaped space connected together along one edge of the cuboid space and one edge of the base of the wedge shaped space.

Further aspects and features of the invention will be described with reference to the following exemplary embodiments of the invention, in which.

Figure 4:
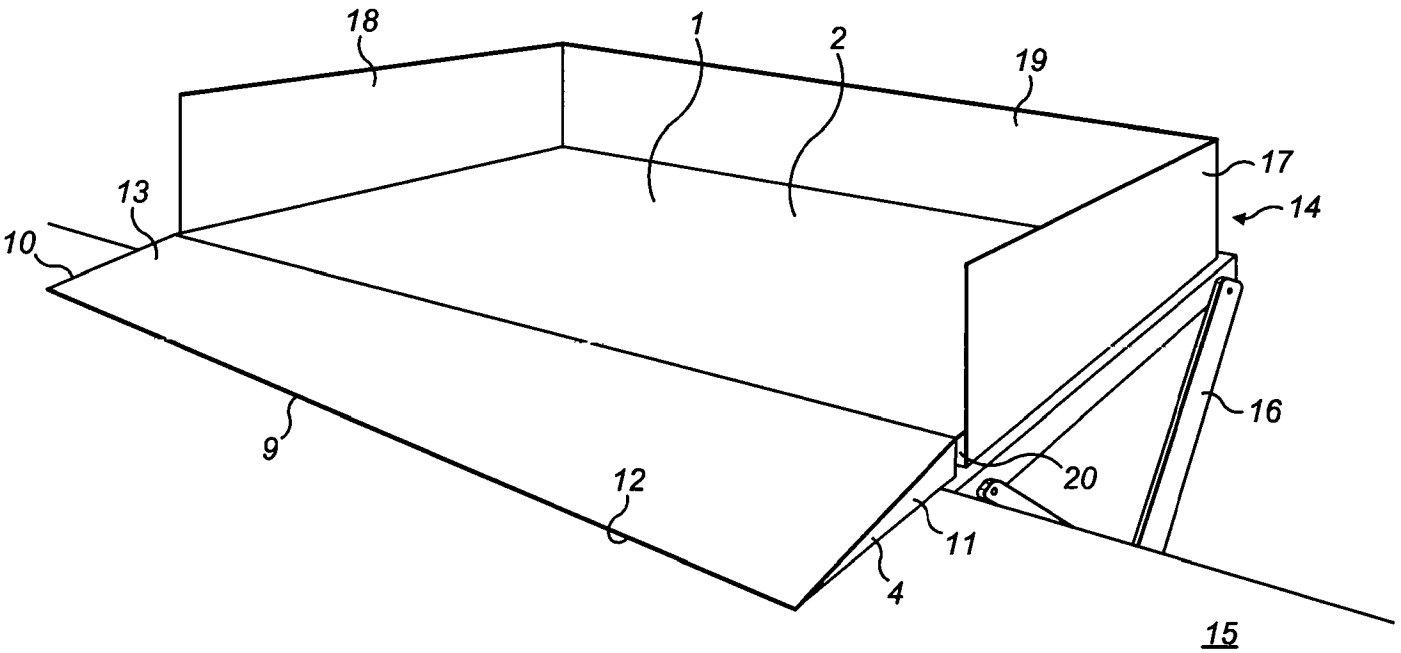
FIG. 4 shows a perspective view of the mattress of FIGS. 1 to 3 in located in a bedside cot and in the horizontal position.
Figure 5:
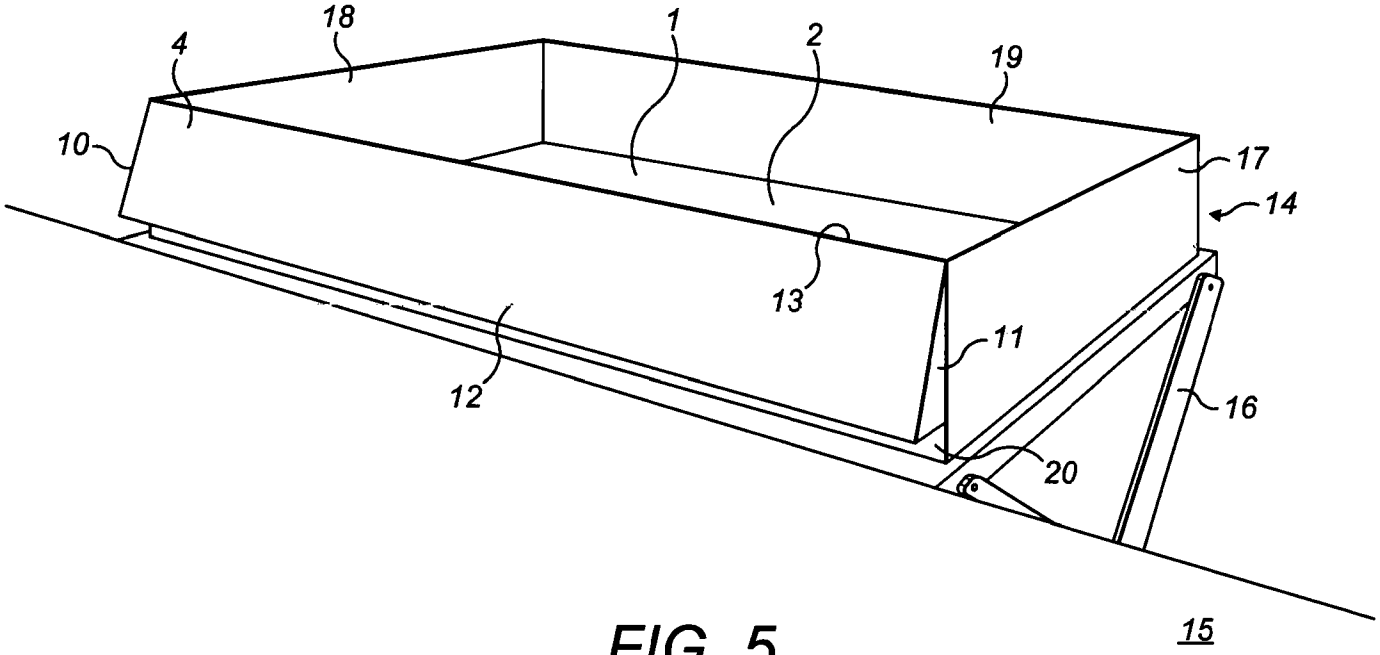
Figure 6:
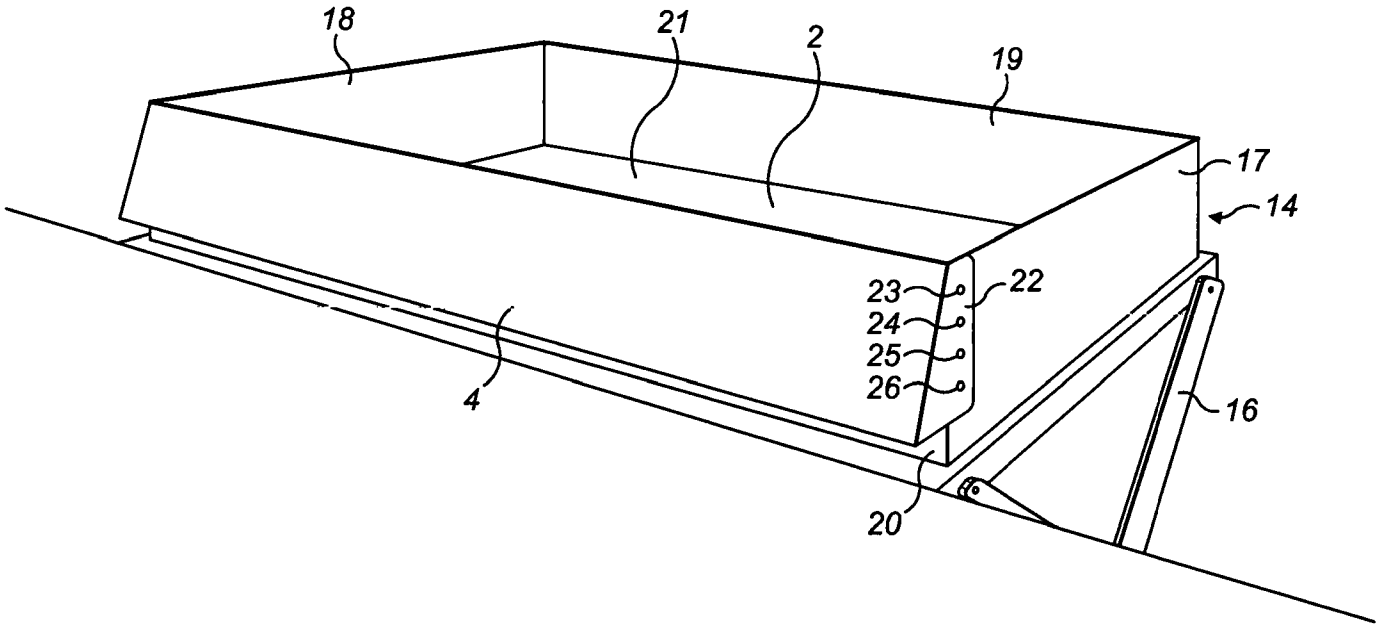

FIG. 5 the mattress and cot of FIG. 4, in which the sidewall of the mattress is in the upright position; and FIG. 6 shows a perspective view of a cot including a mattress having a sidewall according to a second embodiment of the invention.

Figure 1:
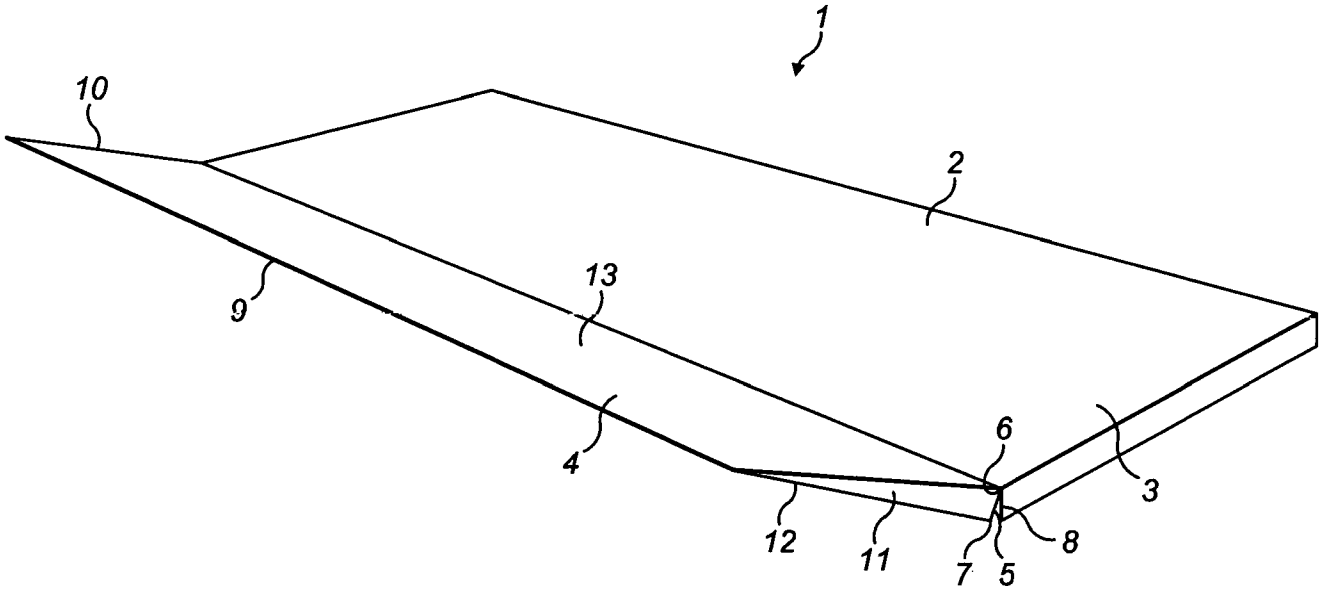
FIG. 1 shows a perspective view of a mattress including a sidewall according to a first embodiment of the invention.
Figure 2:
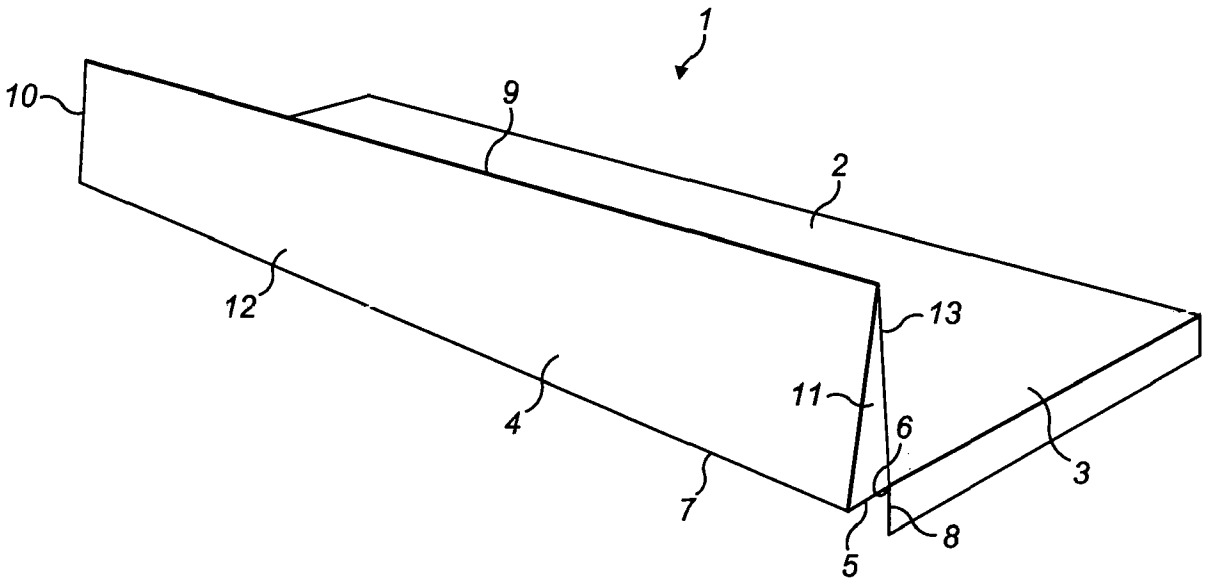
FIG. 2 shows a perspective view of the mattress of FIG. 1 in which the sidewall is in an upright position.
Figure 3:
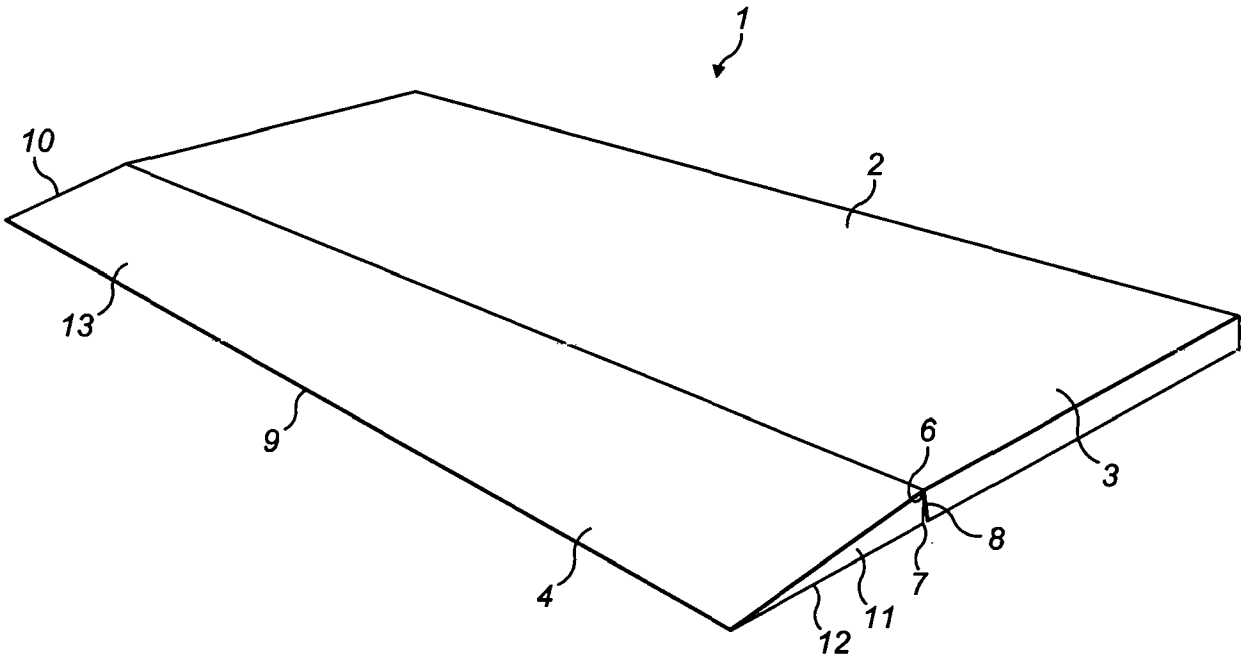
FIG. 3 shows a perspective view of the mattress of FIGS. 1 and 2 in which the sidewall is in a horizontal, or bridging, position.

Referring to FIGS. 1 to 3, a mattress 1 is shown, including a rectangular mattress body 2, which is sized and shaped to fit into a bedside cot, e.g. from about 35 cm×85 cm×3.5 cm for a small crib, to about 60 cm×120 cm×10 cm for a larger cot. The mattress body 2 is formed from typical resilient materials, such as upholstery foam, but could be manufactured from more exotic resilient materials, such as natural fibres like wool and coir.

The mattress body 2 is covered with a flexible waterproof cover 3 of sheet material. The cover 3 covers the outer surfaces of the mattress body 2 and may be removable.

The mattress of the invention also includes a wall, in this case a sidewall 4, which extends from one long side of the rectangular mattress body 2. The sidewall 4 can pivot from an upright position shown in FIG. 2, in which it forms a sidewall of a cot, to a horizontal position, shown in FIG. 3 in which it acts as a bridge between the cot and a bed. An in-between position is shown in FIG. 1, in which the sidewall 4 is neither up nor down. It will be understood that the expression upright is intended to mean generally upright, not exactly in the direction of the zenith, and likewise, horizontal is intended to refer to the plane generally perpendicular to the vertical, not exactly perpendicular thereto, i.e. horizontal enough to serve its purpose as a bridge and upright enough to serve its purpose as a sidewall.

The sidewall 4 is also manufactured from a resilient material, such as upholstery foam (e.g. polyester foam), or suitable natural fibres (e.g. coir and wool) and is also covered with the waterproof cover 3. The cover 3 which covers the mattress body 2 and the sidewall 4 can be formed by two separate covers connected together, e.g. by sewing.

The sidewall 4 has a base 5, which in the upright position has a first inward edge 6 and a second outward edge 7. The first inward edge 6 is connected to the long side of the mattress body 2 adjacent the top edge of its outward end 8, and can pivot about the longitudinal axis defined by the region in which the inward edge 6 of the base 5 of the sidewall 4 and the top edge of the outward end 8 of the mattress body 2 are connected.

The cover 3 connects the mattress body 2 to the sidewall 4 such that in the upright position the first, inward, edge 6 is adjacent the top edge of the outward end 8 of the mattress body and the second, outward, edge 7 of the base 5 of the sidewall 4 is located further outward in a horizontal plane. The connection in this region allows the sidewall 4 to be pivoted downwards through the position shown in FIG. 1, to the position shown in FIG. 3, in which the first edge 6 of the base 5 of the sidewall 4 remains adjacent the top edge of the outward end 8 of the mattress body 2 and the second edge 7 is situated beneath the first edge 6, adjacent the bottom edge of the outward end 8 of the mattress body 2.

The sidewall 4 is of generally rectangular construction, having long sides defined by the base 5 and the distal edge 9, with two opposite shorter ends 10,11. However, whereas the rectangular mattress body 2 is of constant depth, forming a cuboid, the sidewall 4 tapers away from the base 5 to the distal edge 9, so as to form a wedge, with a triangular cross section in the plane perpendicular to the longitudinal axis defined above, such that the shorter ends 10, 11 are triangular.

An outer rectangular surface 12 extends from the second, outward, edge 7 of the base 5 of the sidewall, to its distal edge 9 and an inner rectangular surface 13 extends from the first, inward, edge 6 to the distal edge 9. The outer rectangular surface 12 may include a board (not shown) or similar flat supporting member, inside the cover 3 to provide structural rigidity to the sidewall 4.

The taper is gradual, with the height (h) of the sidewall (the distance between the base 5 and the distal edge 9) being substantially greater than the depth (d) of the base 5 (the distance between the inward edge 6 and the outward edge 7), such that h>d, preferably h>2 d, more preferably h>3 d and more preferably still, h>5 d.

As shown in FIGS. 4 and 5, in use, the mattress 1 is located in a bedside cot 14, which is positioned alongside (and normally attached to) a bed 15. The bedside cot 14 includes a stand 16, a base (not shown) and three walls—two end walls 17, 18 and a sidewall 19. The bedside cot 14 also includes an upstanding lip 20, best seen in FIG. 5, which along with the walls 17,18,19 hold the mattress body 2 in place in the bedside cot 14.

As can be seen in FIG. 5, when the sidewall 4 of the mattress 1 is in the upright position, it serves as a fourth wall of the bedside cot 14, providing a safe space, out of which a baby will not fall. This configuration with the sidewall 4 upright, may be used whilst a parent sleeps.

Various fastening means are envisioned, which could maintain the upright position, such as magnets (not shown) in the ends 10, 11 of the sidewall 4 towards the distal edge 9, which co-operate with magnets (not shown) in the end walls, 17, 18 of the bedside cot. The weight of a baby on the mattress body 2 may even cause the sidewall 4 to be held upright more securely.

When a parent wishes to interact with a baby within the bedside cot 14, the sidewall 4 is unfastened and pivoted into the horizontal, bridging, position shown in FIG. 4, in which the outer rectangular surface 12 overlies the upper surface of the mattress on the bed 15. A continuous sleeping surface is thus provided extending from the mattress body 2, along the inner rectangular surface 13, onto the mattress of the parent bed 15, with no gap between the bridging portion and the mattress body. The upper surface of the sidewall 4 (the inner rectangular surface 13) is resilient and will thus compress easily under the weight of a baby or parent in the same manner as their mattresses to avoid discomfort. Moreover, courtesy of the tapering wedge shape of the sidewall 4, there is only minimal discontinuity between the distal edge 9 of the sidewall 4 and the mattress of the parent bed 15, further aiding comfort.

A fitted sheet (not shown) may be provided to cover the mattress body 2 and the sidewall 4 and preferably both. In order to cover both the sidewall 4 and the mattress body 2, the fitted sheet comprises a cuboid space and a wedge-shaped space connected together along one edge of the cuboid space, corresponding to the top edge of the outward end 8 of the mattress body 2 and one edge of the wedge shaped space corresponding to the inner edge 6 of the base 5 of the sidewall 4.

A second embodiment is shown in FIG. 6, in which like numerals represent like features. The mattress 21 of the second embodiment, is also formed of a mattress body 2 and sidewall 4, but in this case, the ends of the sidewall 4 are each provided with flaps of fabric 22 including snap fasteners 23, 24, 25, 26, which co-operate with corresponding fasteners (not shown) on the outside of the end walls 17, 18 of the bedside cot 14.

It will be clear to those skilled in the art that numerous modifications may be made to the sidewall 4, mattress 1,21 and bedside crib 14 discussed above and as such, the scope of the invention should be determined by reference to the appended claims.

For example, as an alternative to the lip 20, the mattress body 2 or cover 3 could be provided with fasteners on e.g. its underside to connect to the base or walls 17,18,19 of the bedside cot to keep the mattress 1,21 in place. In another example, the sidewall could form part of the bedside cot 14, rather than the mattress 1,21. As yet another example, the sidewall 4 could be provided as part of a mattress cover 3, rather than part of a mattress per-se, such that the cover 3 can be put onto an ordinary crib/cot mattress, such that the ordinary crib/cot mattress forms the mattress body 2. It is also envisioned that a mattress cover 3 could be provided, into which a wedge-shaped sidewall 4 can be inserted and an ordinary crib/cot mattress can be inserted, in order to provide the mattress of the invention.

The invention claimed is:

1. A bedside cot positioned adjacent to a bed comprising at least two stationary walls and a wall capable of pivoting from a first upright position, wherein the at least two stationary walls and the wall form an enclosure housing a mattress body, to a second horizontal position to create a ramp connecting the mattress body to the bed, the wall being formed of a resilient material comprising foam, wherein a resilient part of the wall comprising the resilient material is attached to a backing board, such that in the horizontal position a resilient portion of the resilient part overlies the backing board, the backing board adding structural rigidity to the wall and supporting the resilient part, wherein the resilient part springs back after being compressed providing a comfortable cushioned surface for an infant, wherein the backing board is supported at least partially inside a cover, wherein the mattress body and at least a portion of the wall are inside the cover, the cover providing a substantially continuous bridge between the mattress body and the bed.

2. The bedside cot according to claim 1 wherein the wall tapers from a base of the wall to a distal edge of the wall, further wherein, responsive to being in the second horizontal position the base is adjacent to and coplanar with a top edge of the mattress body.

3. The bedside cot according to claim 1 wherein the wall comprises upholstery foam.

4. The bedside cot according to claim 3 wherein the upholstery foam is polyester upholstery foam.

5. The bedside cot according to claim 1 wherein the wall includes a cover covering an outer surface.

6. The bedside cot according to claim 5 wherein the cover is waterproof.

7. The bedside cot according to claim 1 claims further comprising fasteners for fastening the wall to the bedside cot or the like in the upright position.

8. The bedside cot according to claim 7 wherein the fasteners are snap-fasteners.

9. A bedside cot comprising:

a wall capable of pivoting from a first upright position to a second horizontal position;

the wall being formed of a resilient material; and the bedside cot being mounted on a stand couplable to a parent bed, the bedside cot adjacent to said parent bed, and the wall capable of pivoting from the first upright position in which the wall serves as a first wall of a plurality of walls of the bedside cot, providing an enclosed space, to the second horizontal position in which the wall overlies a parent mattress of the parent bed in order to allow access to the bedside cot and to create a ramp connecting a mattress body in the bedside cot to the bed, wherein the wall comprises a resilient part and a rigid backing part, such that in the horizontal position a resilient portion of the resilient part overlies the backing part, the resilient part comprising a material comprising at least one of upholstery foam, wool and coir, wherein the at least one of upholstery foam, wool and coir comprises a padded surface for the infant, the backing part adding structural rigidity to the wall and supporting the resilient part, wherein the wall is coupled to a top edge of one of a plurality of sides of the mattress body at a connection location, wherein the connection location provides a substantially continuous bridge between the mattress body and the wall.

10. The bedside cot according to claim 9 wherein the bedside cot comprises a mattress cover, the mattress cover including the wall capable of pivoting, and wherein the mattress cover comprises a flexible sheet having an opening to envelope the mattress and arranged such that in use one end of the mattress is situated adjacent a base of the wall, the cover connecting the mattress and the wall, such that the wall can pivot between the first upright position perpendicular to the mattress to the second horizontal position alongside the mattress.

11. The bedside cot according to claim 10 wherein the cover connects the mattress to the wall such that in the first upright position the base of the wall has a first inward edge and a second outward edge, with the first inward edge of the base of the wall adjacent a top edge of an outward end of the mattress and in the second horizontal position, the first inward edge remains adjacent the top edge of the outward end of the mattress and the second outward edge is lower than the first inward edge.

12. The bedside cot according to claim 10 wherein the mattress cover comprises a cuboid space and a wedge-shaped space connected together along one edge of the cuboid space and one edge of a base of the wedge-shaped space.

13. The bedside cot according to claim 9 wherein the wall comprises upholstery foam.

14. The bedside cot according to claim 9 wherein a resilient part of the wall is attached to a backing board, such that in the horizontal position a resilient portion overlies the backing board.

15. The bedside cot according to claim 9 further comprising fasteners for fastening the wall to the bedside cot or the like in the upright position.

16. A bedside cot comprising:

a wall coupled to a mattress body, the wall pivots from a first upright position to a second horizontal position;

the wall being formed of a resilient material; and the bedside cot being mounted on a stand couplable to a parent bed, the bedside cot adjacent to said parent bed, and including the wall capable of pivoting from the first upright position in which the wall serves as a first wall of a plurality of walls of the bedside cot, providing an enclosed space, to the second horizontal position in which the wall overlies the parent bed in order to allow access to the bedside cot, wherein a resilient part of the wall is attached to a rigid backing part, such that in the horizontal position a resilient portion of the resilient part overlies the backing part, the resilient part comprising a cushioned material that compresses responsive to an applied force and rebounds into its original shape absent the force, the backing part adding structural rigidity to the wall and supporting the resilient part, wherein the wall is coupled to a top edge of one of a plurality of sides of the mattress body at a connection location, wherein the connection location provides a substantially continuous bridge between the mattress body and the bed.

17. The bedside cot according to claim 16 wherein resilient part comprises upholstery foam.

18. The bedside cot according to claim 16 wherein a resilient part of the wall is attached to a wherein backing part is a backing board, such that in the horizontal position a resilient portion overlies the backing board.

19. The bedside cot according to claim 16 further comprising fasteners for fastening the wall to the bedside cot or the like in the upright position.

* * * * *